US007097059B2

(12) United States Patent
Saito et al.

(10) Patent No.: US 7,097,059 B2
(45) Date of Patent: Aug. 29, 2006

(54) BLOW-MOLDED BOTTLE

(75) Inventors: Hiromichi Saito, Koto-ku (JP); Takao Iizuka, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 187 days.

(21) Appl. No.: 10/475,329

(22) PCT Filed: Apr. 26, 2002

(86) PCT No.: PCT/JP02/04228

§ 371 (c)(1),
(2), (4) Date: Oct. 21, 2003

(87) PCT Pub. No.: WO02/087978

PCT Pub. Date: Nov. 7, 2002

(65) Prior Publication Data

US 2004/0144747 A1 Jul. 29, 2004

(30) Foreign Application Priority Data

Apr. 27, 2001 (JP) ..... 2001-132266

(51) Int. Cl.
*B65D 1/02* (2006.01)
*B65D 1/42* (2006.01)

(52) U.S. Cl. ..... 215/383; 215/379; 215/382; 220/671; 220/673; 220/675

(58) Field of Classification Search ..... 215/379, 215/382, 383, 675; 220/669, 671, 673, 675
See application file for complete search history.

(56) References Cited

U.S. PATENT DOCUMENTS

| | | | | |
|---|---|---|---|---|
| 4,372,455 | A * | 2/1983 | Cochran | 215/385 |
| 5,064,081 | A | 11/1991 | Hayashi et al. | |
| 6,588,612 | B1 * | 7/2003 | Dorn et al. | 215/10 |
| D486,739 | S * | 2/2004 | Taylor et al. | D9/530 |
| 2004/0011785 | A1 * | 1/2004 | Van Der Heijden et al. | 220/4.13 |

FOREIGN PATENT DOCUMENTS

| | | |
|---|---|---|
| JP | U 63-97607 | 6/1988 |
| JP | A 63-203541 | 8/1988 |
| JP | U 4-84121 | 7/1992 |
| JP | 680612 | * 11/1994 |
| JP | A 7-205258 | 8/1995 |
| JP | U 3050587 | 5/1998 |
| JP | 10329820 | * 12/1998 |

* cited by examiner

*Primary Examiner*—Sue A. Weaver
(74) *Attorney, Agent, or Firm*—Oliff & Berridge, PLC.

(57) ABSTRACT

A blow-molded bottle includes a shoulder and a body that includes an upper body section, a lower body section, and a transversal recessed rib disposed between the upper body section and the lower body section. The upper body section has four lateral walls and four corner walls, each being arranged between two adjacent lateral walls. The lower body section also has four lateral walls and four corner walls, each being arranged between two adjacent lateral walls. The corner wall is formed with an axially extending recess that includes tapered walls.

5 Claims, 2 Drawing Sheets

BLOW-MOLDED BOTTLE

FIELD OF THE INVENTION

This invention relates to a blow-molded bottle. More particularly, it relates to a bottle which cross section is a substantially tetragonal chamfered along corners thereof.

BACKGROUND ART

It is known that a bottle has a body having a substantially tetragonal cross section chamfered along corners thereof, and that the corner walls acts or operates as pillars. It has been required recently to decrease an amount of raw material resin from the view of conserving natural resources and protecting the environment. As a result, bottles of the type under consideration are required to have a reduced wall thickness.

However, if the wall thickness is reduced, conventional bottles of the type under consideration come to be short of rigidity, because they have flat and substantially vertical corner walls. Unless the corner walls are reinforced, the bottle body would happen to be crushed particularly when an internal pressure of the bottle changes and/or the bottle is subjected to an impact.

In view of the above identified problem, it is therefore the object of the present invention to provide a bottle having reinforced corner walls at the body thereof.

SUMMARY OF THE INVENTION

According to the invention, the above object is achieved by providing a blow-molded bottle having a shoulder and a body which cross section is a substantially tetragonal chamfered along corners thereof, wherein the body includes an upper body section, a lower body section, and a transversal recessed rib disposed between the upper body section and the lower body section, the upper body section has four lateral walls and four corner walls, each being arranged between two adjacent lateral walls, the lower body section also has four lateral walls and four corner walls, each being arranged between two adjacent lateral walls, and the corner wall is formed with an axially extending recess which comprises tapered walls.

Preferably, said recess comprises a narrow bottom arranged at a center thereof in a lateral direction, and tapered walls. Preferably, all the corner walls are formed with the axially extending recess which comprises tapered walls.

PREFERRED EMBODIMENT OF THE INVENTION

Now, the present invention will be described by referring to the accompanying drawings that illustrate a preferred embodiment of the invention.

Figure 1:
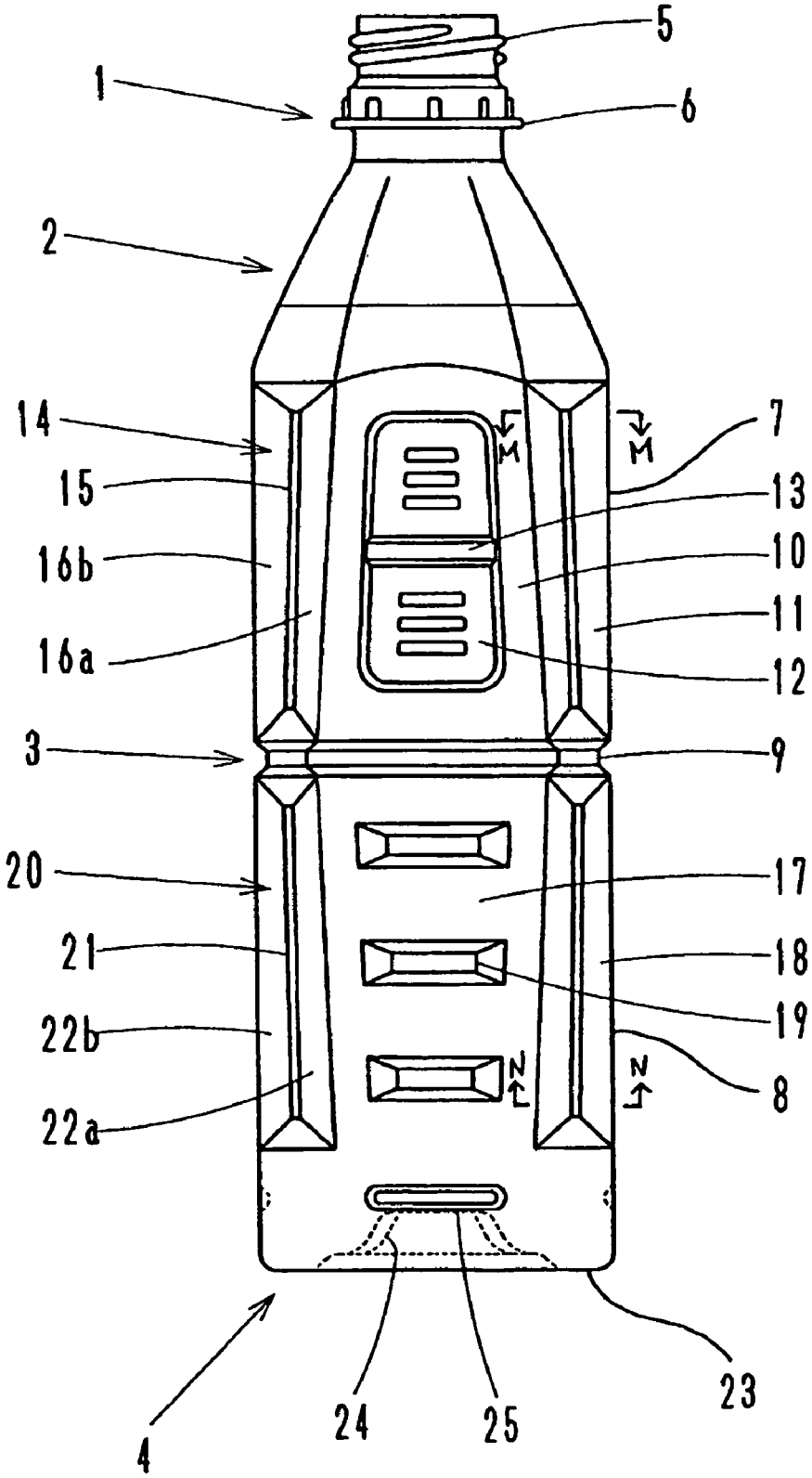
FIG. 1 is a schematic front view of a bottle according to the invention.
Figure 2:
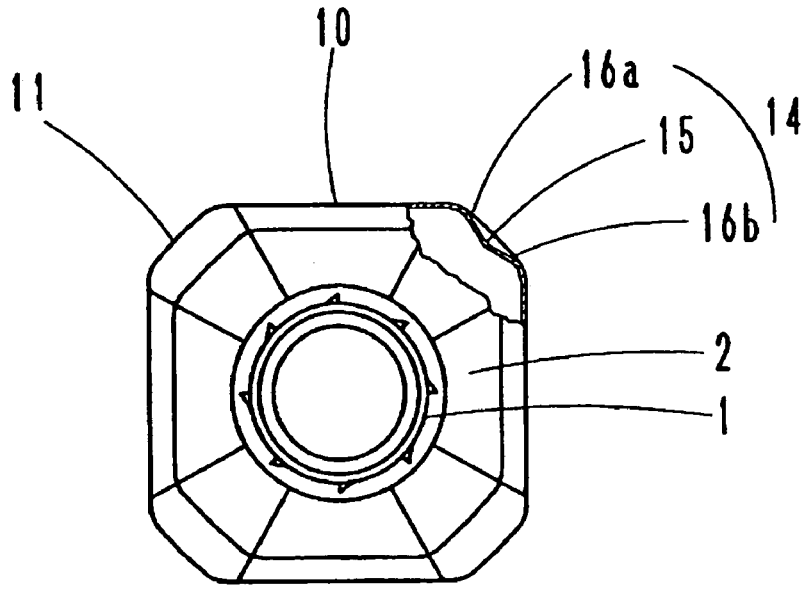
FIG. 2 is a schematic plan view of the bottle of FIG. 1 partially cut along line M—M to show an end facet.
Figure 3:
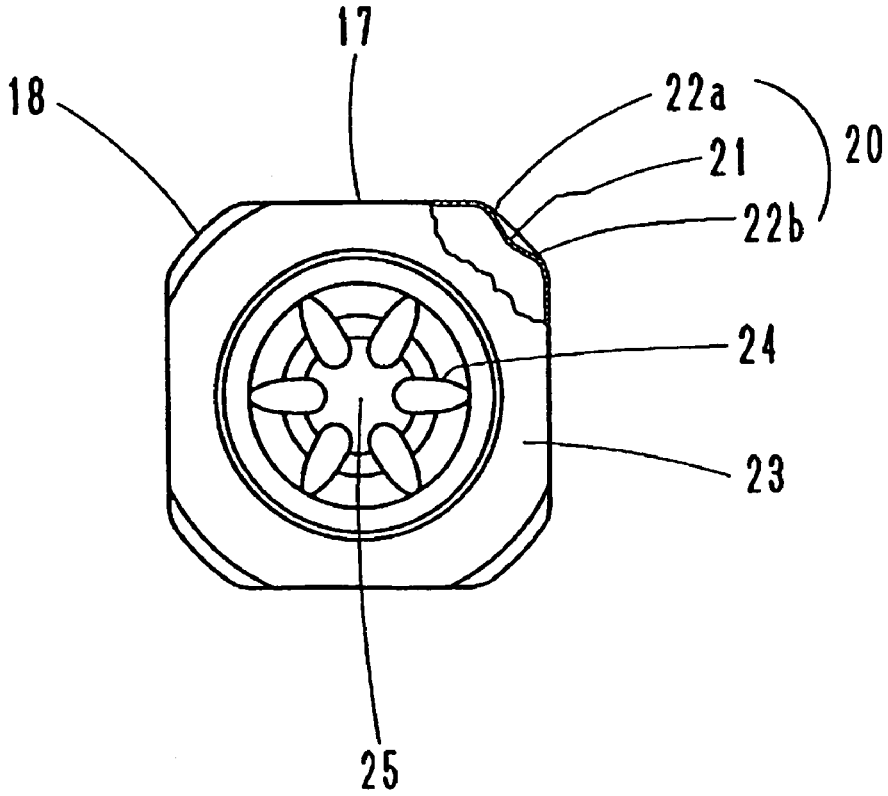
FIG. 3 is a schematic bottom view of the bottle of FIG. 1 partially cut along line N—N to show an end facet.

A bottle as shown in FIGS. 1 through 3 are manufactured by blow-molding synthetic resin (e.g., polyethyleneterephthalate resin), and comprises a neck 1, a shoulder 2, a body 3 and a bottom 4.

The neck 1 is provided with a thread 5 and a neck ring 6.

The shoulder 2 is arranged between the neck 1 and the body 3. The shoulder 2 has a substantially tetragonal cross section, which corners are chamfered (in other words, a distorted octagonal cross section).

The body 3 also has a substantially tetragonal cross section, which corners are chamfered (in other words, a distorted octagonal cross section). While the cross sections of both the shoulder 2 and the body 3 is a substantially square cross section in the illustrated embodiment, they may be a substantially rectangular or polygonal. The body 3 includes an upper body section 7 and a lower body section 8, and a transversal recessed rib 9 is arranged between the upper body section 7 and the lower body section 8.

The upper body section 7 has four lateral walls 10 and four corner walls 11. Each of the corner walls 11 is arranged between two adjacently located lateral walls 10, 10. In each of the corner walls 11, a width at a lower end thereof is smaller than that at an upper end, in the illustrated embodiment. Each of the lateral walls 10 is connected smoothly to the adjacently located corner walls 11, 11, and the corner between the lateral wall 10 and the corner wall 11 does not show any edge. Such bottle in which each of the lateral walls 10 and the adjacently located corner walls 11, 11 are connected smoothly shows a good moldability.

Each of the corner walls 11 has an axially extending recess 14. In the case of the illustrated embodiment, the recess 14 includes a narrow bottom 15 and a pair of tapered walls 16*a*, 16*b*. The bottom 15 is arranged transversally at a center of the recess 14. Each of the tapered walls 16*a*, 16*b* is arranged between the bottom 15 and the corresponding lateral end of the corner wall 11.

Like the upper body section 7, the lower body section 8 has four lateral walls 17 and four corner walls 18. Each of the corner walls 18 is arranged between two adjacently located lateral walls 17, 17. The upper body section 7 and the lower body section 8 are substantially axy-symmetrical relating to the transversal rib 9 (except the flat panels 12, the transversal ribs 13 and the transversal recessed ribs 19).

Each of the lateral walls 17 is provided with a plurality of transversal recessed ribs 19.

In the case of the illustrated embodiment, each of the corner walls 18 has a width at a lower end thereof is smaller than that at an upper end, in the illustrated embodiment. Although each of the corner walls 11 has the smaller width at the lower end and greater width at the upper end and each of the corner walls 18 has the larger width at the lower end and greater width at the upper end in the illustrated embodiment, the corner walls 11 and the corner walls 18 may alternatively have a uniform width. When the width of the corner walls 11 and that of the corner walls 18 are reduced as they approach the transversal recessed rib 9, areas (of the lateral walls 10, 17) that can absorb changes in an internal pressure of the bottle can be increased at a middle of the bottle (near the transversal recessed rib 9), so that the bottle can largely absorb changes in the internal pressure.

Each of the corner walls 18 is formed with an axially extending recess 20. In the illustrated embodiment, the recess 20 includes a narrow bottom 21 and a pair of tapered walls 22*a*, 22*b*. The bottom 21 is arranged transversally at a center of the recess 20.

Although each of the recesses 14, 20 of the illustrated embodiment has the bottom 15 or 21, no bottoms 15, 21 may be formed, and each of the recesses (14, 20) may comprises only a pair of tapered walls (16*a*, 16*b* or 22*a*, 22*b*). Although all the corner walls have a recess in the illustrated embodiment, it may alternatively be so arranged that only some of the corner walls have a recess. For example, it may be so arranged that only the corner walls 11 of the upper body section 7 have a recess, or only the corner walls 18 of the lower body section 8 have a recess.

The bottom 4 includes a bottom wall 23 extended from the lower body section and a dome 25 that expands upward and is provided with a plurality of radial ribs 24. However, the bottom of a bottle according to the invention is not limited to the illustrated one.

The corner walls 11, 18 of the bottle according to the invention act or operate as pillars like prior art bottles. Additionally, the corner walls 11, 18 are provided with respective recesses 14, 20, each of which includes a pair of tapered walls 16*a*, 16*b* or 22*a*, 22*b*. With this arrangement, the corner walls 11, 18 show a raised rigidity. Furthermore, when the recesses 14, 20 are provided with respective bottoms 15, 21, the rigidity of the corner walls 11, 18 are raised further by the bottoms 15, 21. Still additionally, the rigidity of the corner walls 11, 18 are remarkably improved when all the corner walls are provided with a recess 14 or 20.

Thus, according to the invention, since the corner walls of the body are provided respectively with axially extending recesses, it is now possible to manufacture a thin-walled bottle whose corner walls are reinforced, so as to reduce the amount of resin necessary for manufacturing the bottle.

What is claimed is:

1. A blow-molded bottle having a shoulder and a body which cross section is a substantially tetragonal chamfered along corners thereof, wherein the body includes an upper body section, a lower body section, and a transversal recessed rib disposed between the upper body section and the lower body section, the upper body section has four lateral walls and four corner walls, each being arranged between two adjacent lateral walls, the lower body section also has four lateral walls and four corner walls, each being arranged between two adjacent lateral walls, and at least one of the corner walls in each of the upper body section and the lower body section is formed with an axially extending recess that comprises tapered walls, the axially extending recesses terminating before the transversal recessed rib, wherein a width of the corner walls at an end near the transversal recessed rib is smaller than a width of the corner walls near an opposite end of the corner walls.

2. The bottle according to claim 1, wherein the recesses comprise a narrow bottom arranged at a center thereof in a lateral direction, and tapered walls.

3. The bottle according to claim 1, wherein all the corner walls are formed with the axially extending recess, which comprises tapered walls.

4. The bottle according to claim 2, wherein all the corner walls are formed with the axially extending recess, which comprises tapered walls.

5. The bottle according to claim 1, wherein each of the four lateral walls is provided with a plurality of transversal lateral ribs.

* * * * *